US007748243B2

(12) United States Patent
Park et al.

(10) Patent No.: US 7,748,243 B2
(45) Date of Patent: Jul. 6, 2010

(54) WASHING MACHINE

(75) Inventors: Hye Yong Park, Changwon-si (KR); Bo Yeon Kim, Changwon-si (KR); Dae Hee Kwon, Busan-si (KR); Hyun Seok Kim, Seoul (KR); Seong Yeol Lee, Daegu-si (KR)

(73) Assignee: LG Electronics Inc., Seoul (KR)

( * ) Notice: Subject to any disclaimer, the term of this patent is extended or adjusted under 35 U.S.C. 154(b) by 682 days.

(21) Appl. No.: 11/404,117

(22) Filed: Apr. 14, 2006

(65) Prior Publication Data

US 2006/0255700 A1 Nov. 16, 2006

(30) Foreign Application Priority Data

Apr. 15, 2005 (KR) ..... 10-2005-0031476
Apr. 15, 2005 (KR) ..... 20-2005-0010494 U
Apr. 16, 2005 (KR) ..... 20-2005-0010568 U

(51) Int. Cl.
*D06F 17/00* (2006.01)

(52) U.S. Cl. ..... 68/196; 68/142; 312/228

(58) Field of Classification Search ..... 68/142, 68/196; 312/228.1, 228
See application file for complete search history.

(56) References Cited

U.S. PATENT DOCUMENTS 3,026,699 A * 3/1962 Rhodes ..... 68/12.19
2003/0172689 A1* 9/2003 Fitton et al. ..... 68/12.26
2004/0168484 A1* 9/2004 Kim et al. ..... 68/24
2004/0221479 A1* 11/2004 Lee et al. ..... 34/603
2006/0081015 A1* 4/2006 Rizzetto et al. ..... 68/3 R

FOREIGN PATENT DOCUMENTS

DE 4327916 A1 * 2/1994
DE 297 02 663 U1 6/1998
DE 198 07 401 A1 8/1999
EP 0 937 809 B1 5/2003
JP 08168588 A * 7/1996

OTHER PUBLICATIONS

Machine Translation of Nishimura et al. JP 08-168588, Feb. 1996.*
Machine Translation of Bergmann et al., DE 4327916, Feb. 1994.*

* cited by examiner

*Primary Examiner*—Michael Barr
*Assistant Examiner*—David Cormier
(74) *Attorney, Agent, or Firm*—McKenna Long & Aldridge LLP

(57) ABSTRACT

A washing machine is provided. The washing machine includes a cabinet cover and a drain passage forming portion formed on the cabinet cover.

20 Claims, 21 Drawing Sheets

WASHING MACHINE

This application claims the benefit of Korean Patent Application No. 10-2005-31476, filed on Apr. 15, 2005; Korean Patent Application No. 20-2005-10494, filed Apr. 15, 2005 and Korean Patent Application No. 20-2005-10568, filed on Apr. 16, 2005, which are hereby incorporated by reference for all purposes as if fully set forth herein.

BACKGROUND OF THE INVENTION

1. Field of the Invention

The present invention relates to a washing machine.

2. Description of the Related Art

Generally, washing machines include a drum in which laundries such as garments, linens, and fabrics (hereinafter, referred to collectively as fabrics) are washed by water and detergent (hereinafter, referred to as wash water) fed into a tub in washing mode. Then, the garments are rinsed and excess water is extracted from the garments in rinsing and spinning modes.

During use or transportation of the washing machine, a cabinet cover of the washing machine can be scratched or deformed, causing degradation in appearance. Further, users may be surfeited with the frontal appearance of the washing machine after long use of the washing machine. In addition, since the cabinet cover is coated with a coating material, the manufacturing process of the cabinet is complicated and manufacturing costs increases.

To eliminate such disadvantages, the cabinet cover can be constructed using a non-coated rear cabinet cover and an exchangeable plastic front cabinet cover attached to a front side of the rear cabinet cover. In this case, although the frontal appearance of the washing machine can be improved and the manufacturing costs can be reduced, water can permeate into the washing machine between the front cabinet cover and the rear cabinet cover, thereby causing noise and corrosion.

SUMMARY OF THE INVENTION

Accordingly, the present invention is directed to a washing machine that substantially obviates one or more problems due to limitations and disadvantages of the related art.

An object of the present invention is to provide a washing machine that has a water draining structure to drain water permeated into a cabinet cover for preventing noise and corrosion caused by the permeated water.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a washing machine including: a cabinet cover; and a drain passage forming portion of the cabinet cover in which a drain passage is formed.

In another aspect of the present invention, there is provided a washing machine including: a front cabinet cover; a rear cabinet cover disposed at a rear side of the front cabinet cover; a rib formed on at least one of the front cabinet cover and the rear cabinet cover; and a drain passage forming portion of the rib in which a drain passage is formed.

In a further another aspect of the present invention, there is provided a washing machine including: a cabinet cover; a drain hole formed in an upper portion of the cabinet cover; and a guide portion guiding water to the drain hole.

In a still further another aspect of the present invention, there is provided a washing machine including: a cabinet cover; and a sloped portion formed on an upper portion of the cabinet cover to allow downflow of water for draining the water.

According to the washing machine of the present invention, the drain passage is included in the cabinet cover such that water permeated between the front cabinet cover and the rear cabinet cover can be discharged to a lower side. Therefore, noise and corrosion caused by the permeated water can be prevented.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
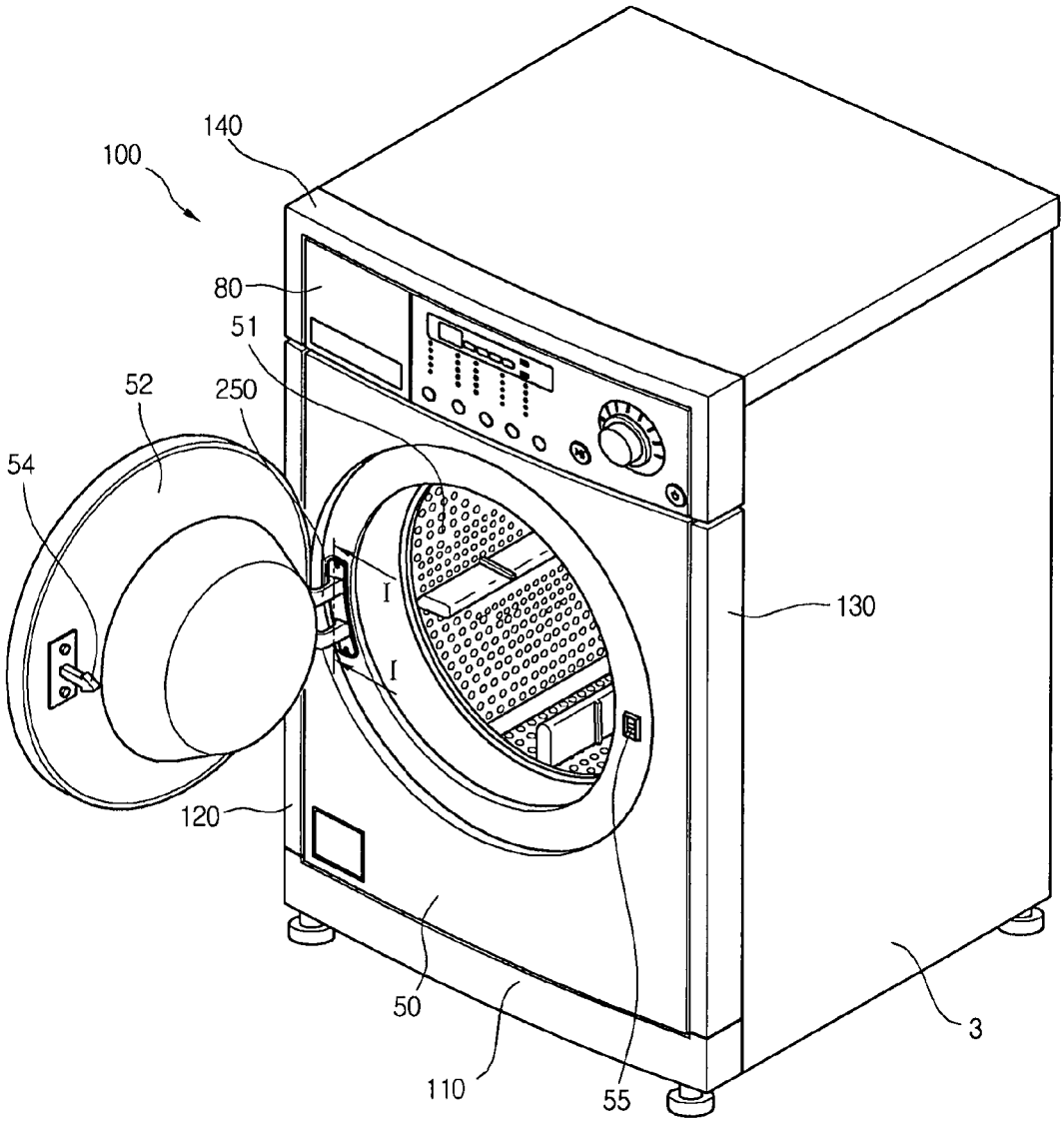
FIG. 1 is a perspective view of a washing machine according to a first embodiment of the present invention.

FIG. 1 is a perspective view of a washing machine according to a first embodiment of the present invention.

Referring to FIG. 1, the washing machine includes a cabinet 3 and a cabinet cover 50 attached to a front side of the cabinet 3.

The cabinet cover 50 includes a fabric opening portion 51 for putting fabrics into the washing machine and taking the fabrics out of the washing machine. A door 52 is installed on the cabinet cover 50 for opening and closing the fabric opening portion 51.

A hinge member 250 is installed between the cabinet cover 50 and the door 52 for allowing rotation of the door 52.

The door 52 includes a hook 54 protruded from a portion opposite to the hinge member 250, and the cabinet cover 50 includes a switch 55 for locking/unlocking the hook 54.

A control panel 80 is disposed above the cabinet cover 50.

An assembling rib is protruded from one of the cabinet cover 50 and the control panel 80, and an assembling hole is formed in the other of the cabinet cover 50 and the control panel 80 for receiving and holding the assembling rib, such that the control panel 80 can be installed on a top portion of the cabinet cover 50 by coupling the assembling rib and the assembling hole.

In the current embodiment of the present invention, a deco panel 100 is attached along left, bottom, right, sides of the cabinet cover 50 and left, top, and right sides of the control panel 80.

The deco panel 100 is used for protecting the cabinet 50 and the control panel 80 and increasing the frontal cosmetic appearance of the washing machine. The deco panel 100 may be provided in one piece or include a plurality of deco panel members 110, 120, 130, and 140 attached around the cabinet cover 50 and the control panel 80. Hereinafter, only the latter case will be described.

The deco panel member 110 is a bottom deco panel member disposed on the bottom side of the cabinet 50. The deco panel member 120 is a left deco panel member disposed on the left side of the cabinet cover 50. The deco panel member 130 is a right deco panel member disposed on the right side of the cabinet cover 50. The deco panel member 140 is a top deco panel member disposed along the left, top, and right sides of the control panel 80.

Figure 2:
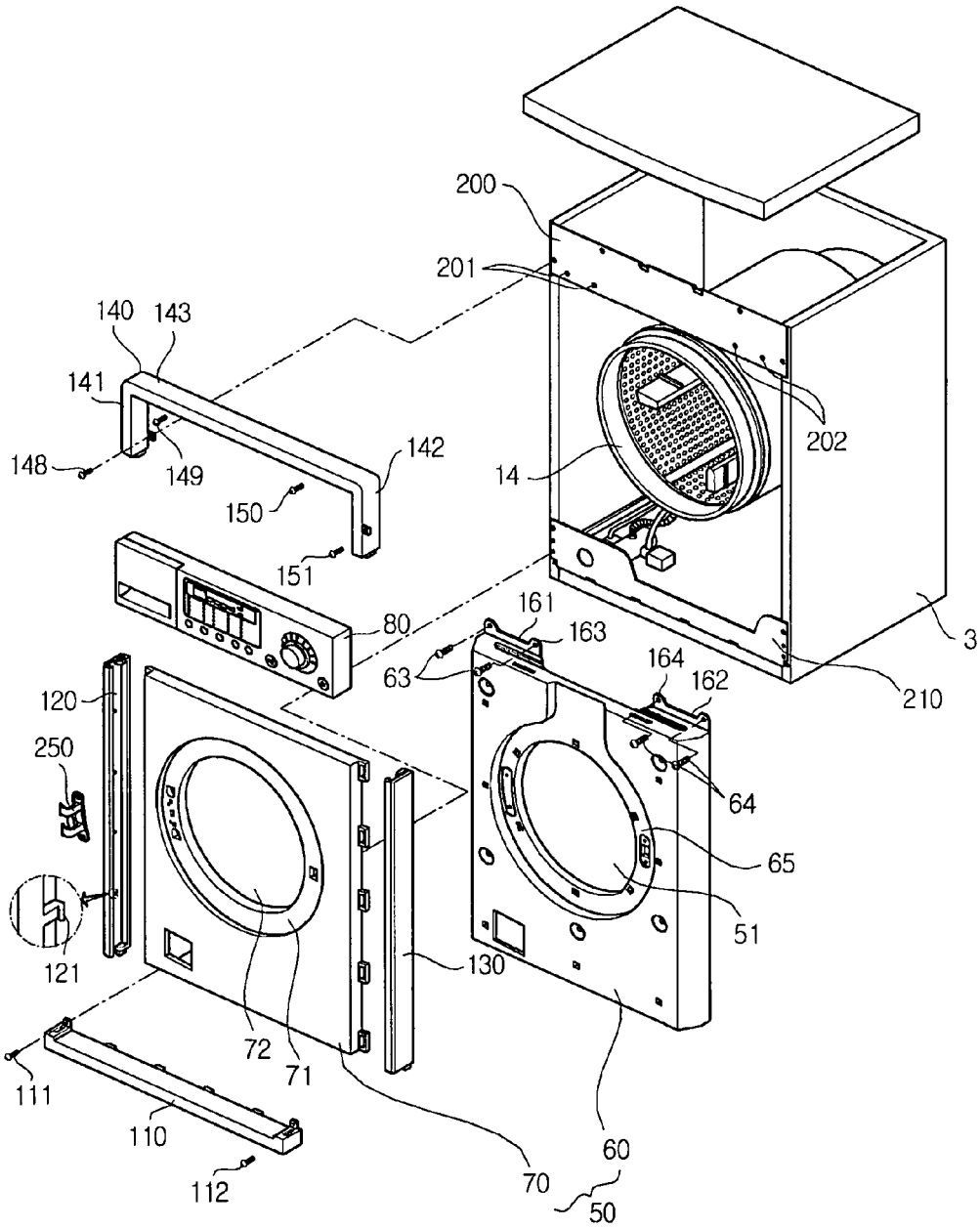
FIG. 2 is an exploded perspective view of the washing machine depicted in FIG. 1.

FIG. 2 is an exploded perspective view of the washing machine depicted in FIG. 1.

Referring to FIG. 2, the washing machine includes a front upper frame 200 installed between front upper ends of the cabinet 3, and a front lower frame 210 installed between front lower ends of the cabinet 3.

The cabinet cover 50 includes a rear cabinet cover 60 and a front cabinet cover 70. The front cabinet cover 70 covers a front side of the rear cabinet cover 60 and forms the frontal exterior of the washing machine.

The rear cabinet cover 60 is formed of metal using various methods such as press die casting. Hereinafter, the case where the rear case cover 60 is formed by the press die casting will only be referred.

Since the rear cabinet cover 60 is covered by the front cabinet cover 70 and is not exposed to the outside, coating or polishing is not required for the rear cabinet cover 60.

The rear cabinet cover 60 includes a left coupling portion 161 and right coupling portion 162 that are protruded from both sides of a top end. When assembled, the coupling portions 161 and 162 are fixed to the front upper frame 200 using coupling members 63 and 64 such as screws.

For this, the front upper frame 200 includes coupling holes 201 and 202 receiving the coupling members 63 and 64, and the left and right coupling portions 161 and 162 include coupling holes 163 and 164 corresponding to the coupling holes 201 and 202 of the front upper frame 200. Therefore, the rear cabinet cover 60 can be securely fixed to the front upper frame 200 by fitting the coupling members 63 and 64 into the coupling holes 163 and 164 of the rear cabinet cover 60, and into the coupling holes 201 and 202 of the front upper frame 200.

The rear cabinet cover 60 includes a bent portion 65 recessed in a backward direction.

The fabric opening portion 51 of the cabinet 50 is formed in the bent portion 65 of the rear cabinet 60.

The fabric opening portion 51 is curled, and a portion of a gasket 14 is fitted around the curled section of the fabric opening portion 51.

The front cabinet cover 70 is formed of plastic by injection molding.

The front cabinet cover 70 couples with the rear cabinet cover 60 to cover the front side of the rear cabinet cover 60.

The front cabinet cover 70 includes a stepped portion 71. The stepped portion 71 is inserted into the bent portion 65 of the rear cabinet cover 60 when the front cabinet cover 70 and the rear cabinet cover 60 are assembled.

When assembled, the bent portion 65 of the rear cabinet cover 60 and the stepped portion 71 of the front cabinet cover 70 are in tight contact with each other and receive the door 51 partially or entirely.

The stepped portion 71 includes an opening 72 having a size larger than the fabric opening 51.

Meanwhile, the bottom deco panel 110, as shown in FIG. 1, has a horizontally elongated shape and disposed on the bottom side of the cabinet cover 50. Referring to FIG. 2, the bottom deco panel 110 includes a left side coupled to a left side of the front lower frame 210 and a left lower end of the cabinet 3 using a coupling member 111 such as a screw, and a right side coupled to a right side of the front lower frame 210 and a right lower end of the cabinet 3 using a coupling member 112 such as a screw.

The left deco panel 120 has a vertically elongated shape and disposed on the left side of the cabinet cover 50 as shown in FIG. 1. The left deco panel 120 is hooked on at least one of the front cabinet cover 70 and the rear cabinet cover 60 as shown in FIG. 2.

The right deco panel 130 has a vertically elongated shape and disposed on the right side of the cabinet cover 50 as shown in FIG. 1. The right deco panel 120 is hooked on at least one of the front cabinet cover 70 and the rear cabinet cover 60 as shown in FIG. 2.

As shown in FIGS. 1 and 2, the top deco panel 140 includes a left portion 141 disposed on the right side of the control panel 80, a right portion 142 disposed on the right side of the control panel 80, and a top portion 143 disposed on the top side of the control panel 80.

The top deco panel 140, as shown in FIG. 2, is coupled to the front upper frame 200 using coupling members 148, 149, 150, and 151 such as screws.

Figure 3:
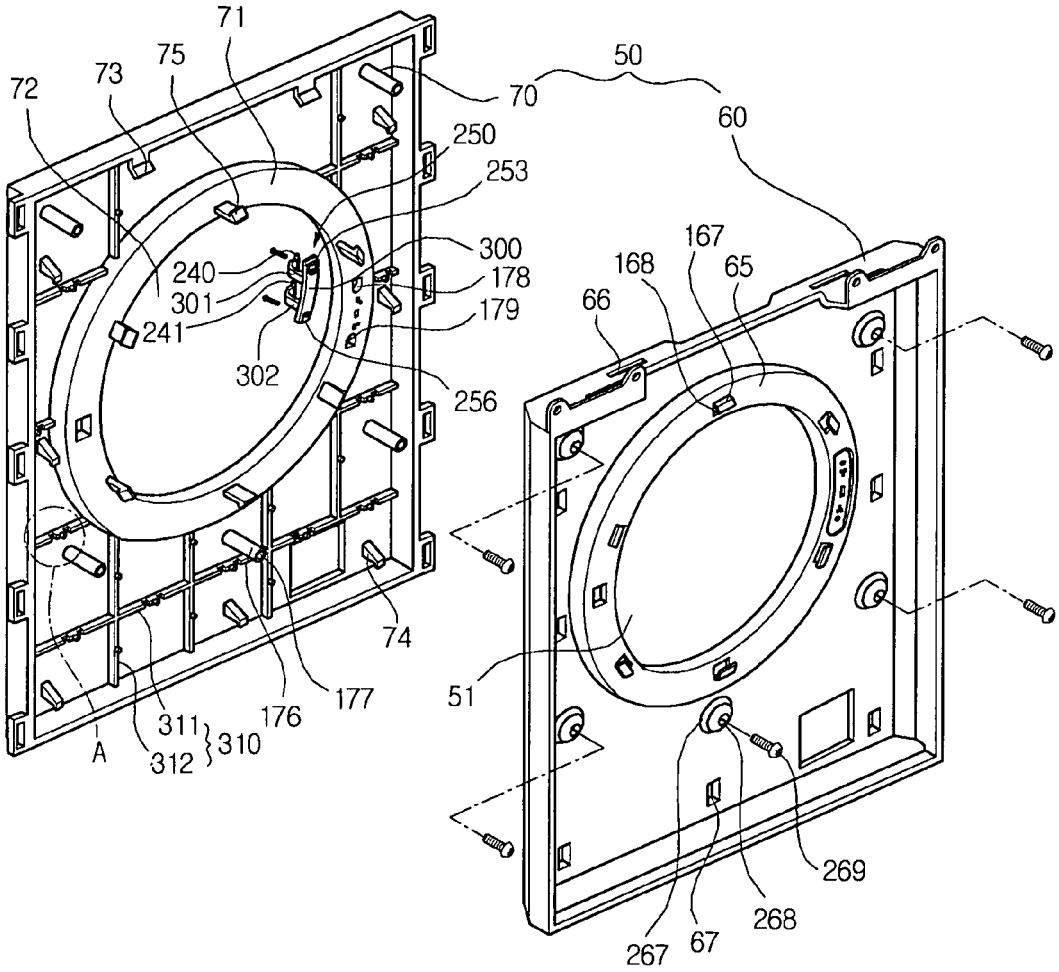
FIG. 3 is a rear perspective view showing a disassembled state of a front cabinet cover and a rear cabinet cover of the washing machine depicted in FIG. 1.
Figure 4:
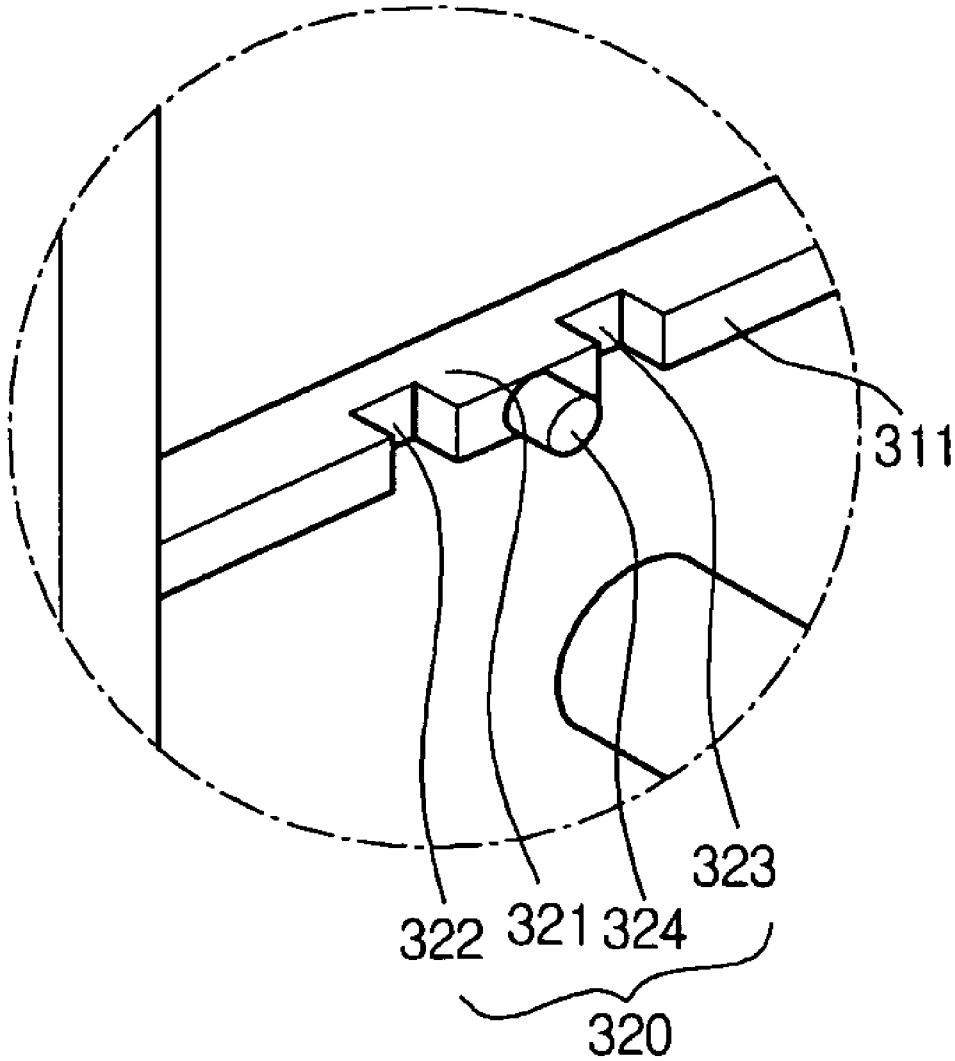
FIG. 4 is an enlarged perspective view of portion A of FIG. 3.
Figure 5:
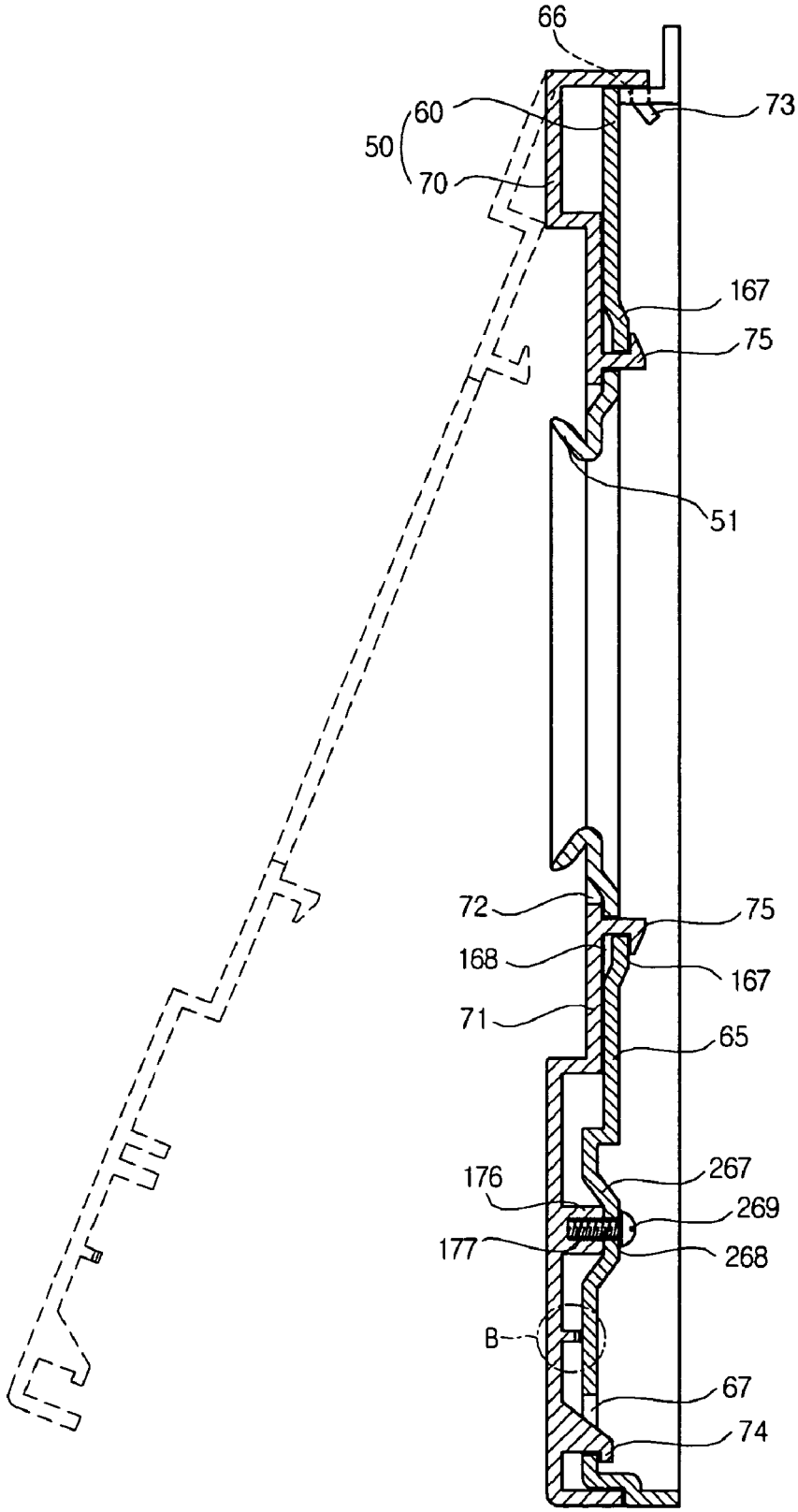
FIG. 5 is a sectional view showing an assembled state of the front cabinet cover and the rear cabinet cover of the washing machine depicted in FIG. 1.
Figure 6:
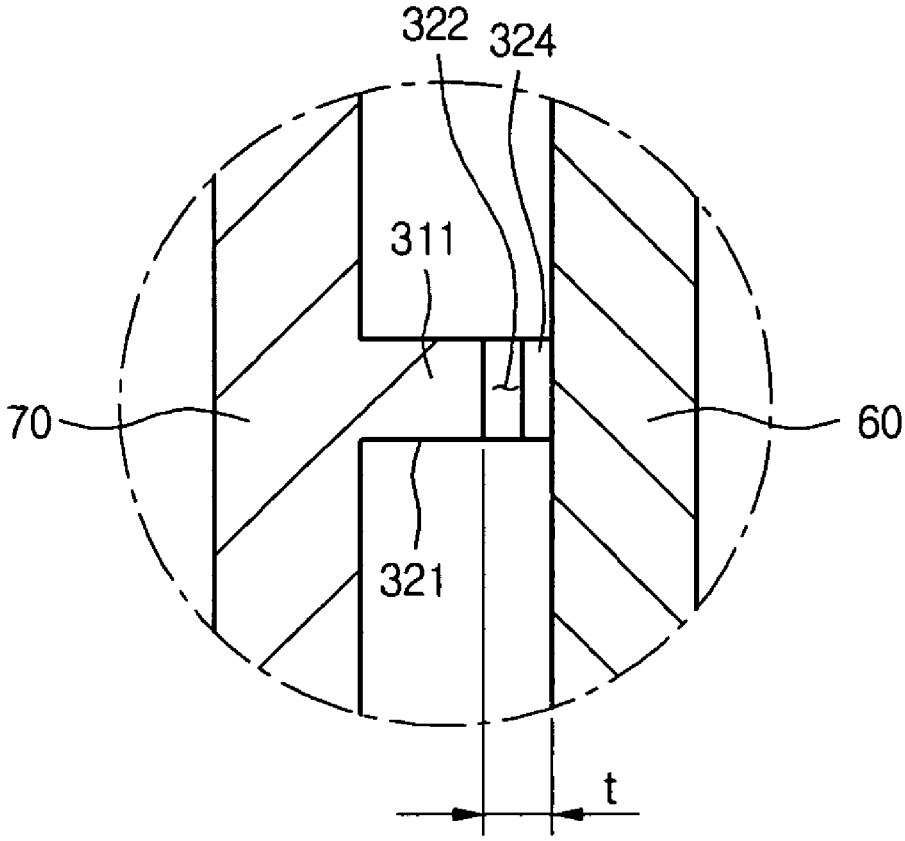
FIG. 6 is an enlarged view of portion B of FIG. 5.

FIG. 3 is a rear perspective view showing a disassembled state of the front cabinet cover 70 and the rear cabinet cover 60 of the washing machine depicted in FIG. 1, FIG. 4 is an enlarged perspective view of portion A of FIG. 3, FIG. 5 is a sectional view showing an assembled state of the front cabinet cover 70 and the rear cabinet cover 60 of the washing machine depicted in FIG. 1, and FIG. 6 is an enlarged view of portion B of FIG. 5.

Referring to FIGS. 3 to 6, the rear cabinet cover 60 includes rib hooking holes 66 that are vertically formed in a top surface, and the front cabinet cover 70 includes hooking ribs 73. When assembled, the hooking ribs 73 are held in the rib hooking holes 66. The front cabinet cover 70 further includes hooks 74 protruded from a rear surface, and the rear cabinet cover 60 further includes hook holes 67 that are formed in a front-to-back direction. After the hooking ribs 73 are inserted into the rib hooking holes 66, the front cabinet cover 70 is rotated on the hooking ribs 73 to insert the hooks 74 to a hooking position in the hook holes 67. In this way, the front cabinet cover 70 and the rear cabinet cover 60 can be temporarily assembled.

The front cabinet cover 70 further includes hooks 75, and the rear cabinet cover 60 includes flanges 167 formed by cutting and bending for receiving and holding the hooks 75.

The hooks 75 and the flanges 167 are formed on narrow portions of the front cabinet cover 70 and the rear cabinet cover 60 since it is difficult to use coupling members such as screws for the narrow portions. That is, the hooks 75 are formed on a rear surface of the stepped portion 71 of the front cabinet cover 70, and the flanges 167 are formed on the bent portion 65 of the rear cabinet cover 60 in correspondence with the hooks 75.

Therefore, the stepped portion 71 of the front cabinet cover 70 and the bent portion 65 of the rear cabinet cover 60 can be securely coupled to each other by inserting the hooks 75 into holes 168 formed in the bent portion 65 for the flanges 167, and by hooking the hooks 75 on the flanges 167.

The front cabinet cover 70 further includes backwardly-protruded bosses 176 each having a coupling hole 177, and the rear cabinet cover 60 includes coupling portions 267 having coupling holes 268 corresponding to the coupling holes 177. The coupling portions 267 have a backwardly projected shape formed by pressing. Therefore, the front cabinet cover 70 and the rear cabinet cover 60 can be more securely assembled by tightening coupling members 269 such as screws into the coupling holes 268 of the coupling portions 267 and the coupling holes 177 of the coupling bosses 176 from the back of the rear cabinet cover 60.

The hinge member 250 includes door coupling portions 240 and 241, a rear cabinet cover coupling portion 300, and hinge connection portions 301 and 302.

The door coupling portions 240 and 241 couples with the door 52. That is, the door 52 is rotatably fixed to the door coupling portions 240 and 241.

The rear cabinet cover coupling portion 300 of the hinge member 250 couples with the rear cabinet cover 60. The rear cabinet cover coupling portion 300 includes an upper coupling section 253 and a lower coupling section 256.

The hinge connection portions 301 and 302 connect the door coupling portions 240 and 241 with the rear cabinet cover coupling portion 300.

The upper and lower coupling sections 253 and 256 include straight edges and round edges. The straight edges are formed in directions opposite to the directions of the round edges.

The front cabinet cover 70 includes an upper coupling section evasion hole 178 and a lower coupling section evasion hole 179. In detail, the upper coupling section evasion hole 178 includes a straight edge corresponding to the straight edge of the upper coupling section 253 and a round edge corresponding to the round edge of the upper coupling section 253. The lower coupling section evasion hole 179 includes a straight edge corresponding to the straight edge of the lower coupling section 256 and a round edge corresponding to the round edge of the lower coupling section 256.

The straight edges of the upper and lower coupling section evasion holes 178 and 179 are formed in directions opposite to the directions of the round edges of the upper and lower coupling section evasion holes 178 and 179.

The front cabinet cover 70 further includes ribs 310 on its rear surface. The ribs 310 increase the strength of the front cabinet cover 70. The ribs 310 include horizontal ribs 311 formed on the rear surface of the front cabinet cover 70 in a horizontal direction and vertical ribs 312 formed on the rear surface of the front cabinet cover 70 in a vertical direction.

The horizontal ribs 311 and the vertical ribs 312 are formed on the entire rear surface of the front cabinet cover 70 except for the stepped portion 71 and are arranged in horizontal and vertical directions in the form of a lattice. With this configuration, the ribs 310 can increase the strength of the front cabinet cover 70.

The horizontal ribs 311 and the vertical ribs 312 are protruded to a predetermined height from the front surface of the front cabinet cover 70.

Each of the horizontal ribs 311 includes drain passages 322 and 323, such that water permeated between the front cabinet cover 70 and rear cabinet cover 60 can drain downwardly. The drain passages 322 and 323 are formed in a drain passage forming portion 320 of the horizontal rib 311 in the form of a vertically-defined groove.

Preferably, two or more drain passages 322 and 323 are formed in each section of the horizontal rib 311 divided by the vertical ribs 312 and are spaced apart from each other by a predetermined distance.

The drain passage forming portion 320 of the horizontal rib 311 may include a protrusion 324. Preferably, the protrusion 324 may be formed on the drain passage forming portion 320 in close proximity to the drain passages 322 and 323 such that the drain passages 322 and 323 can be spaced a predetermined gap (t) from the rear cabinet cover 60. More preferably, the protrusion 324 may be formed on the drain passage forming portion 320 between the drain passages 322 and 323.

Further, it is preferable that the protrusion 324 have a predetermined embossed shape such that the rib 310 can be in point contact with the front surface of the rear cabinet cover 60 instead of making surface or line contact with the front surface of the rear cabinet cover 60. The protrusion 324 may be formed on each of the horizontal ribs 311 and the vertical ribs 312.

Water draining from the front portion of the washing machine will now be described.

When water permeates between the control panel 80 and the front cabinet cover 70, some of the water flows along the top surface of the front cabinet cover 70 to the top surface of the rear cabinet cover 60, and then flows down into the front portion of the washing machine between the top surfaces of the front cabinet cover 70 and the rear cabinet cover 60.

Then, the water drains down through the drain passages 311 and 312 instead of staying between the horizontal ribs 311 and the rear cabinet cover 60.

The drained water is discharged to the outside of the cabinet cover 50 through lower ends of the front cabinet cover 70 and the rear cabinet cover 60.

Other embodiments of the present invention will now be described. Descriptions of the same elements as in the first embodiment will be omitted.

Figure 7:
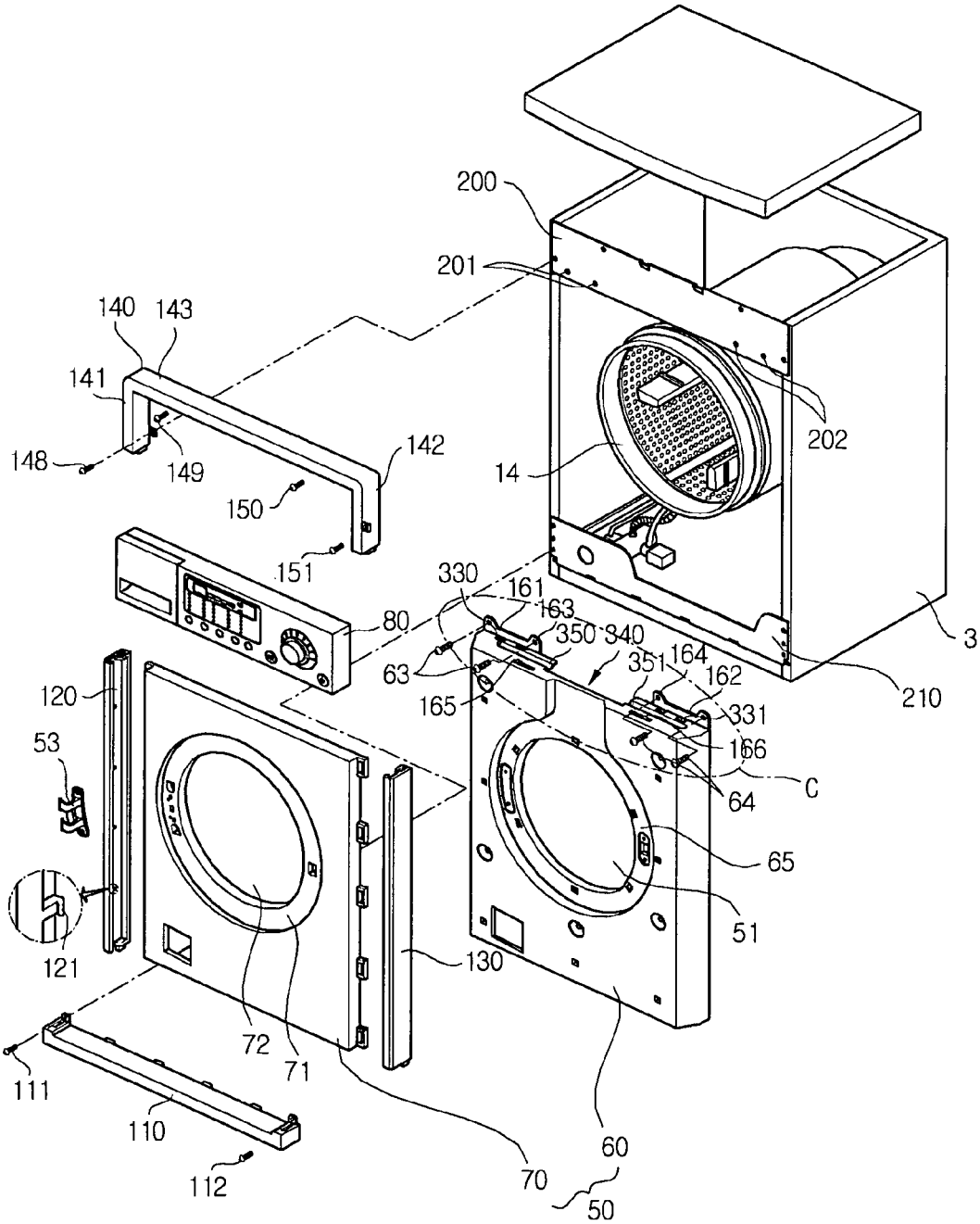
FIG. 7 is an exploded perspective view of a washing machine according to a second embodiment of the present invention.
Figure 8:
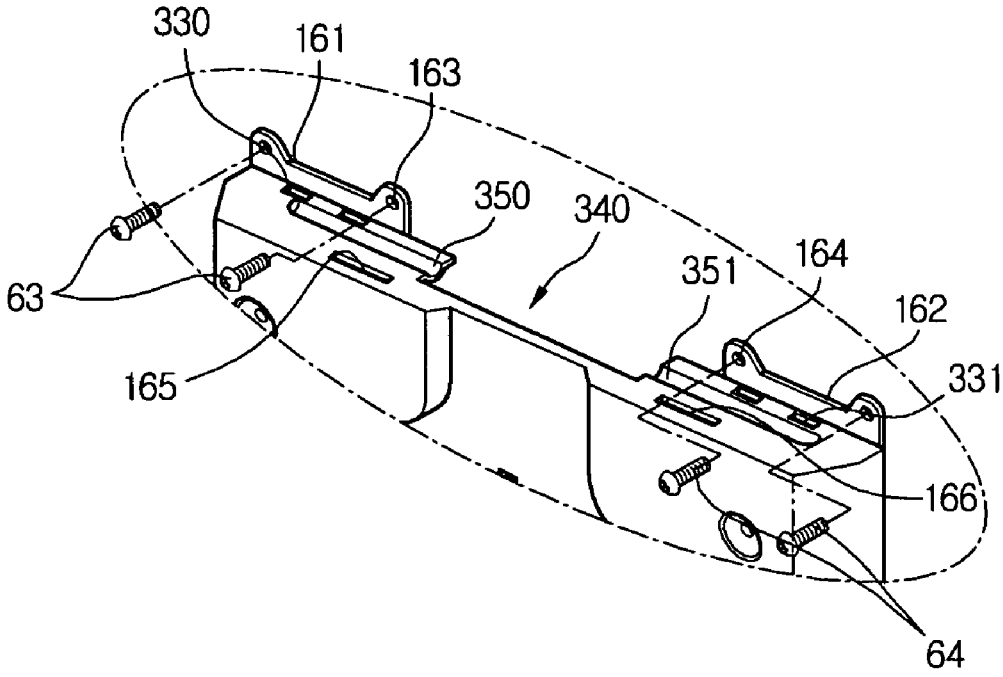
FIG. 8 is an enlarged perspective view of portion C of FIG. 7.
Figure 9:
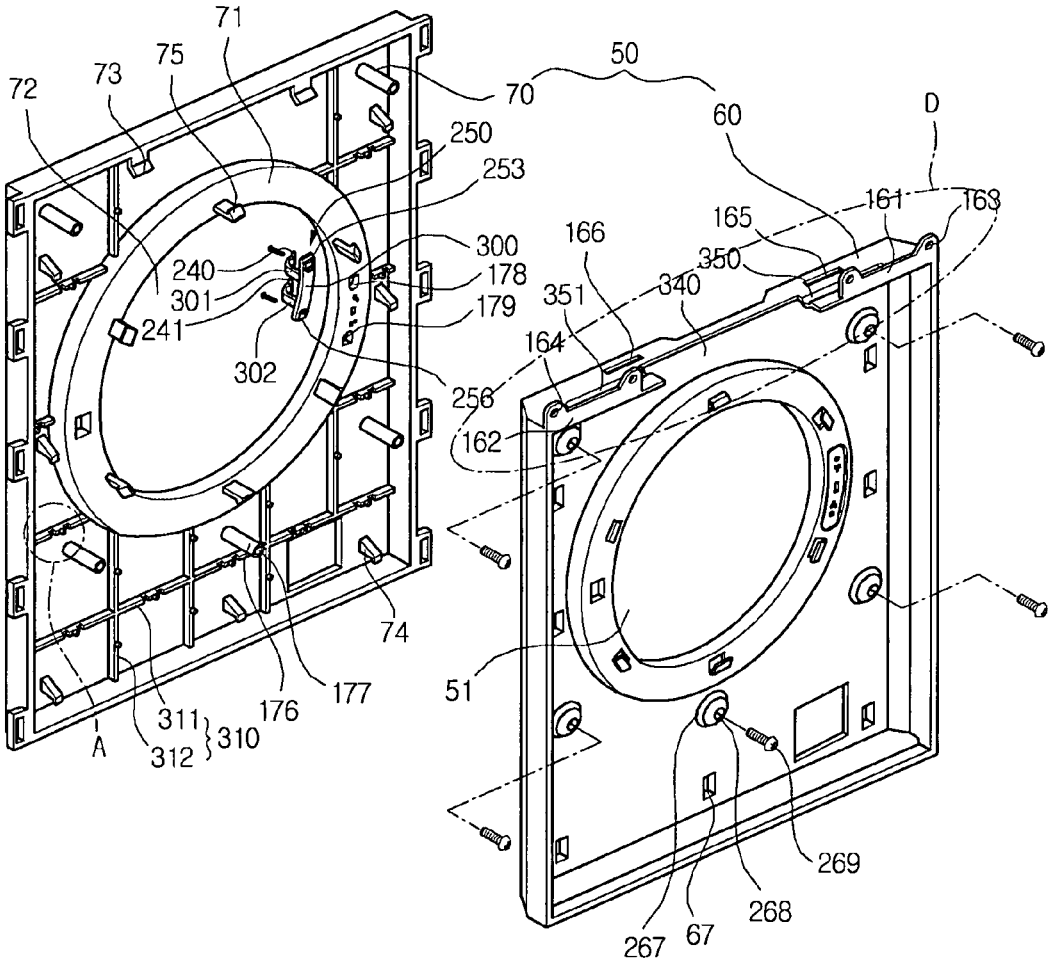
FIG. 9 is a rear perspective view showing a disassembled state of a front cabinet cover and a rear cabinet cover of the washing machine depicted in FIG. 7.
Figure 10:
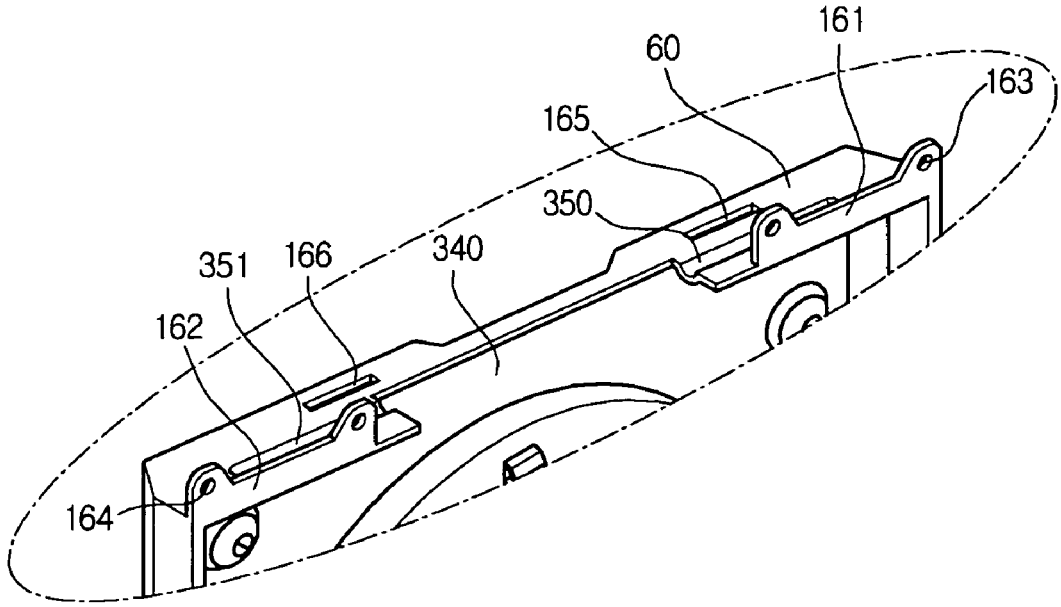
FIG. 10 is an enlarged perspective view of portion D of FIG. 9.
Figure 11:
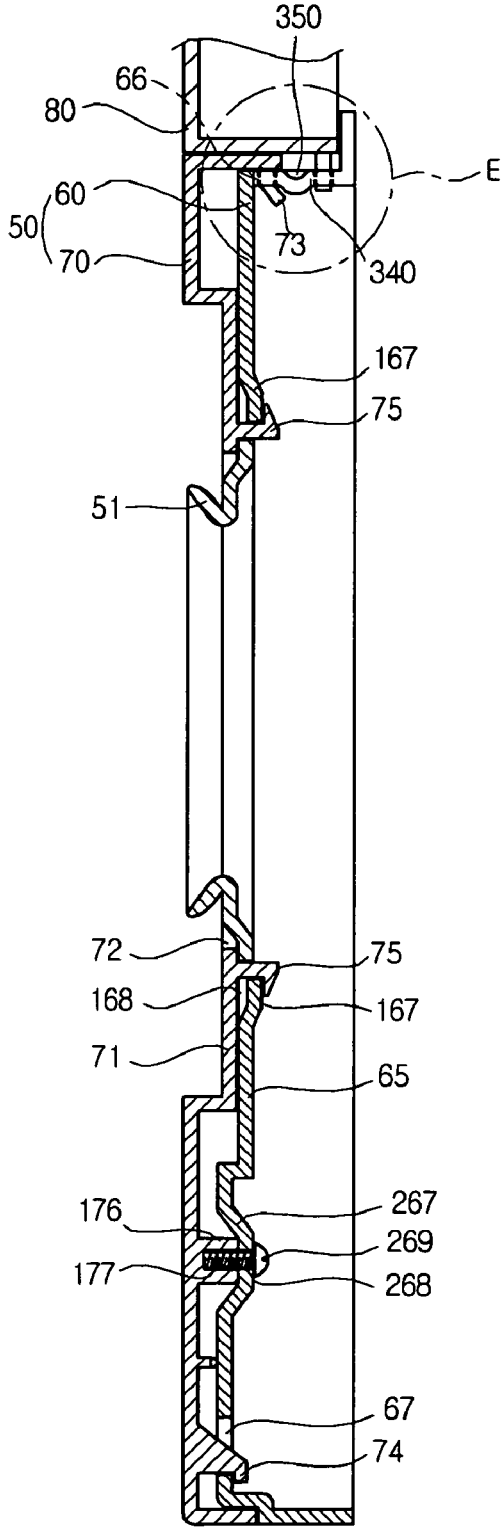
FIG. 11 is a sectional view showing an assembled state of the front cabinet cover and the rear cabinet cover of the washing machine depicted in FIG. 7.
Figure 12:
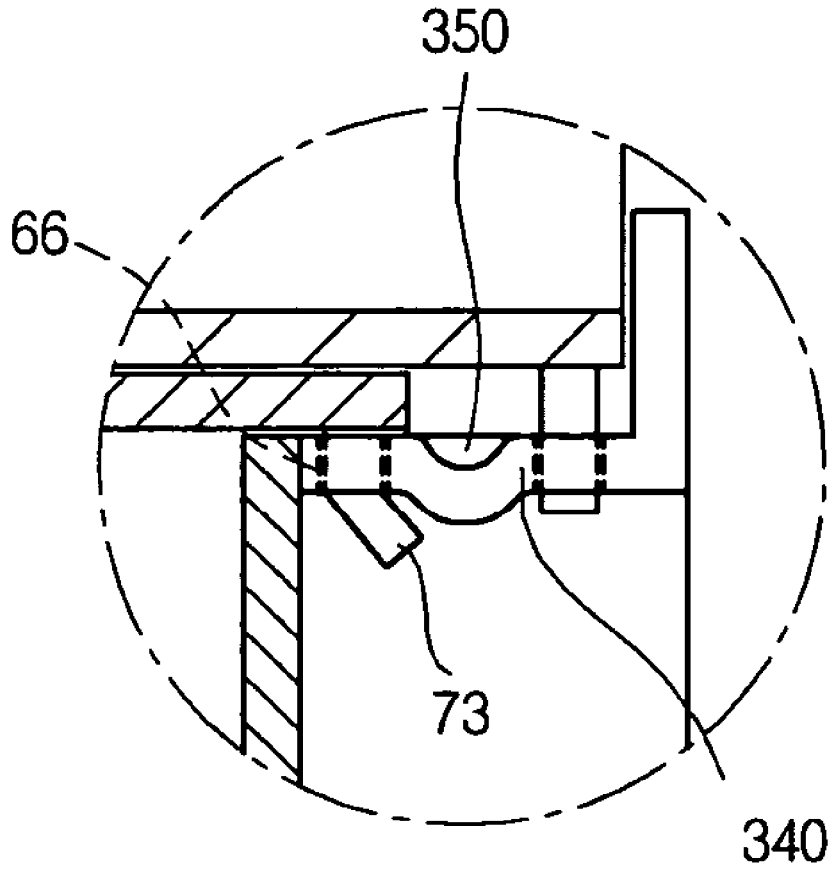
FIG. 12 is an enlarged view of portion E of FIG. 11.

FIG. 7 is an exploded perspective view of a washing machine according to a second embodiment of the present invention; FIG. 8 is an enlarged perspective view of portion C of FIG. 7; FIG. 9 is a rear perspective view showing a disassembled state of a front cabinet cover and a rear cabinet cover of the washing machine depicted in FIG. 7; FIG. 10 is an enlarged perspective view of portion D of FIG. 9; FIG. 11 is a sectional view showing an assembled state of the front cabinet cover and the rear cabinet cover of the washing machine depicted in FIG. 7; and FIG. 12 is an enlarged view of portion E of FIG. 11.

Referring to FIGS. 7 to 12, a rear cabinet cover 60 includes a drain passage forming portion in which a drain passage is formed to prevent water flown onto a top surface of the rear cabinet cover 60 from dropping through coupling holes 330 and 331 toward a hinge member 53 or a door switch 55 (refer to FIG. 1). The drain passage forming portion includes a drain hole 340 vertically formed at a center portion of the top surface of the rear cabinet cover 60, and guide portions 350 and 351 formed at both sides (or one side) of the top surface for directing water to the drain hole 340.

The guide portions 350 and 351 are formed in front of the coupling holes 330 and 331 in a lateral direction. The guide portions 350 and 351 guide water from the top surface the rear cabinet cover 60 to the drain hole 340 to prevent the water from flowing into the coupling holes 330 and 331.

For effective water flow guide, one ends of the guide portions 350 and 351 are communicated with the drain hole 340, and the other ends of the guide portions 350 and 351 are closed. In detail, the (left) guide portion 350 has a concaved groove shape with a right end communicated with the drain hole 340 and a closed left end, and the (right) guide portion 351 has a concaved groove shape with a left end communicated with the drain hole 340 and a closed right end.

Here, it is preferable that the left and right guide portions 350 and 351 be sloped down toward the drain guide 340.

The left and right guide portions 350 and 351 of the rear cabinet cover 60 are located above the hinge member 53 and the door switch 55, and the drain hole 340 is located at a center portion of the top surface of the rear cabinet cover 60 beside the hinge member 53 and the door switch 55. Therefore, while draining to the outside through the guide portions 350 and 351 and the drain hole 340, water does not reach the hinge member 53 and the door switch 55.

Water draining will now be described according to the second embodiment of the present invention.

If water permeates between the control panel 80 and the front cabinet cover 70, the water flows along the top surface of the front cabinet cover 70 to the top surface of the rear cabinet cover 60.

Some of the water directed to a top center portion of the rear cabinet cover 60 flows down through the drain hole 340 to a rear center portion of the rear cabinet cover 60.

Another portion of the water directed to a top left portion of the rear cabinet cover 60 flows along the left guide portion 350 in a right direction, and then drops down to the rear center portion of the rear cabinet cover 60 through the drain hole 340.

The other portion of the water directed to a top right portion of the rear cabinet cover 60 flows along the right guide portion 351 in a left direction, and then drops down to the rear center portion of the rear cabinet cover 60 through the drain hole 340. Then, the whole water is discharged from the rear center portion of the rear cabinet cover 60 to the outside through a lower portion of the rear cabinet cover 60.

That is, the water flown onto the top surface of the rear cabinet cover 60 flows down to the rear center portion of the rear cabinet cover 60 through the drain hole 340, such that the hinge member 53 and the door switch 55 do not meet the water.

Meanwhile, some water flown onto the top surface of the rear cabinet cover 60 in front of the left and right guide portions 350 and 351 can flow down between the front cabinet cover 70 and the rear cabinet cover 60.

The water flown down between the front cabinet cover 70 and the rear cabinet cover 60 is directed downward through drain passages 322 and 323 (refer to FIG. 4), and then is discharged to a lower side of a cabinet cover 50 through lower ends of the front cabinet cover 70 and the rear cabinet cover 60.

Figure 13:
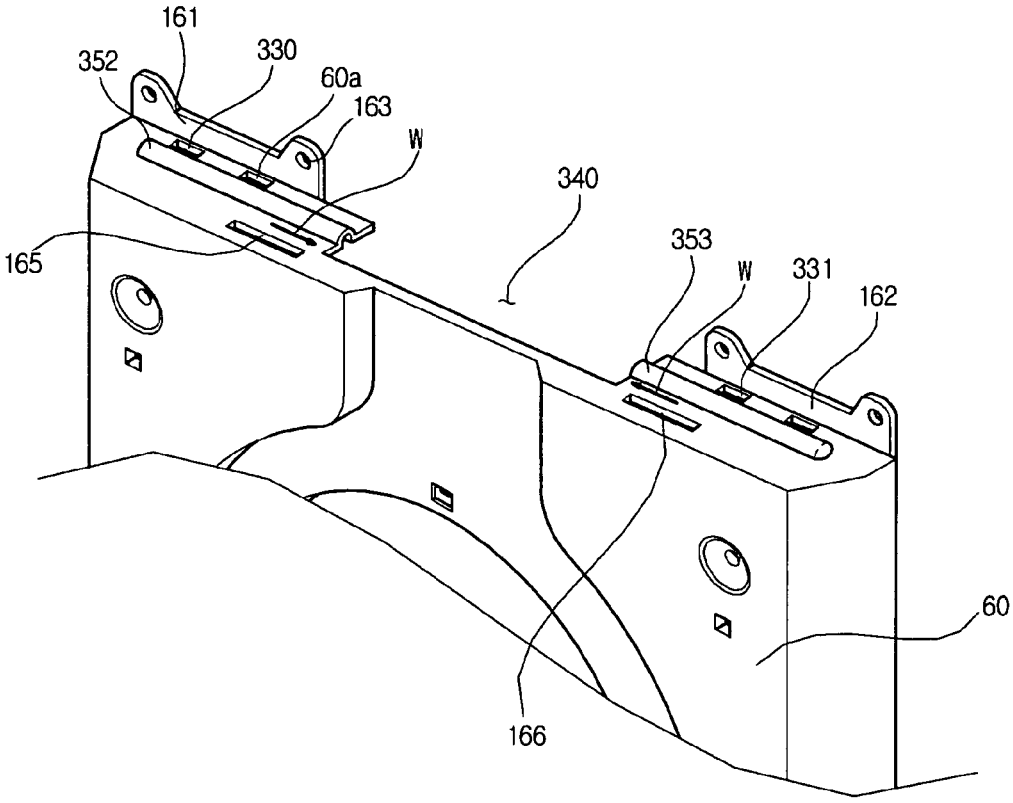
FIG. 13 is a partial perspective view showing an upper portion of a rear cabinet cover of a washing machine according to a third embodiment of the present invention.

FIG. 13 is a partial perspective view showing an upper portion of a rear cabinet cover of a washing machine according to a third embodiment of the present invention.

Referring to FIG. 3, a rear cabinet cover 60 includes guide portions 352 and 353 on a top end. The guide portions 352 and 353 have an upwardly-protruded shape formed by, for example, a pressing process.

The guide portion 352 is formed at a left side of the top end of the rear cabinet cover 60, and the guide portion 353 is formed at a right side of the top end of the rear cabinet cover 60.

In the washing machine of the current embodiment, water (w) flowing on the left side of the top end of the rear cabinet cover 60 is prevented from flowing backward by the left guide portion 352. The water (w) is guided by the left guide portion 352 in a right direction toward a drain hole 340, and then is directed down to a rear center portion of the rear cabinet cover 60.

Water (w) flowing on the right side of the top end of the rear cabinet cover 60 is prevented from flowing backward by the right guide portion 353. The water (w) is guided by the right guide portion 353 in a right direction toward the drain hole 340, and then is directed down to the rear center portion of the rear cabinet cover 60.

Figure 14:
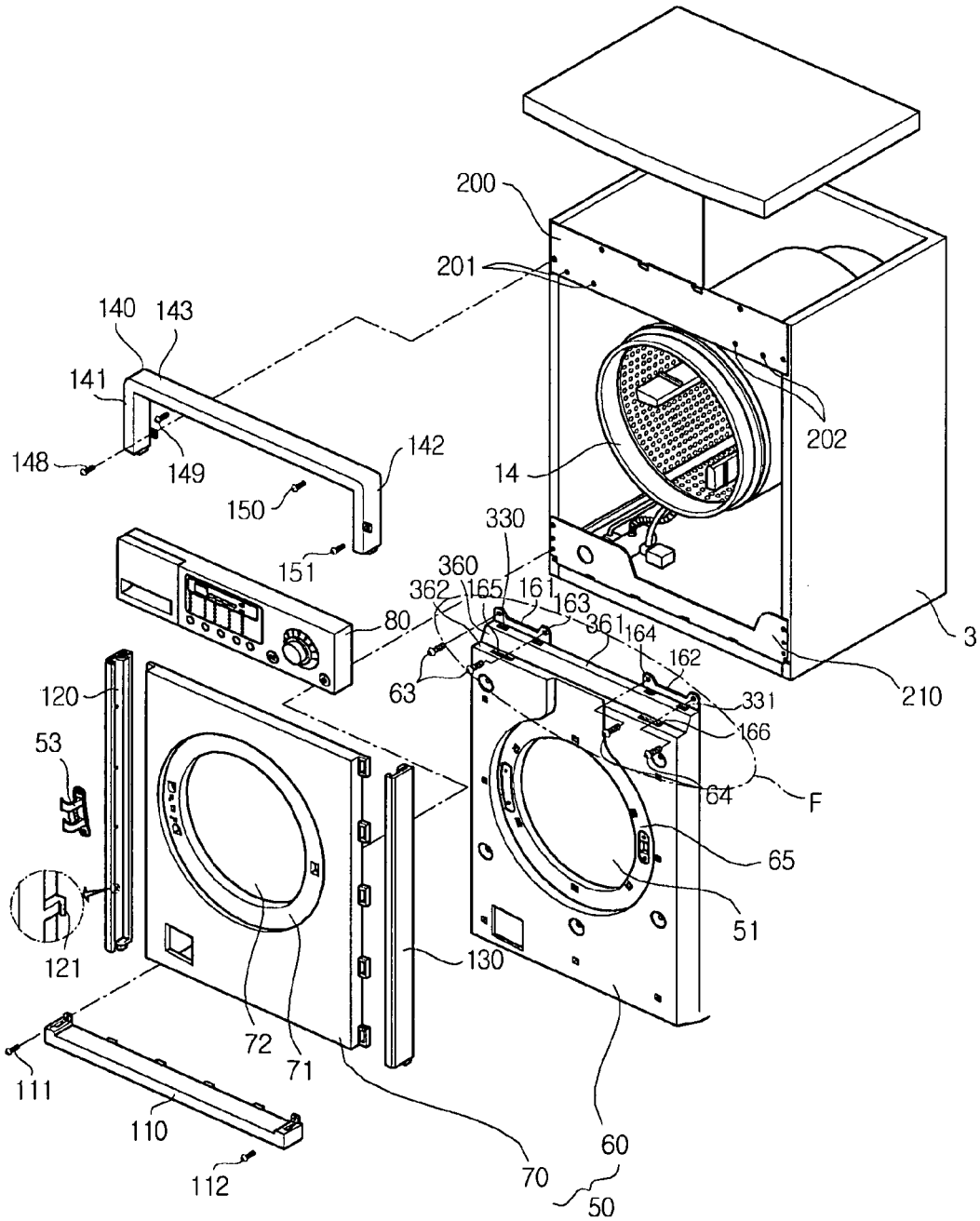
FIG. 14 is an exploded perspective view of a washing machine according to a fourth embodiment of the present invention.
Figure 15:
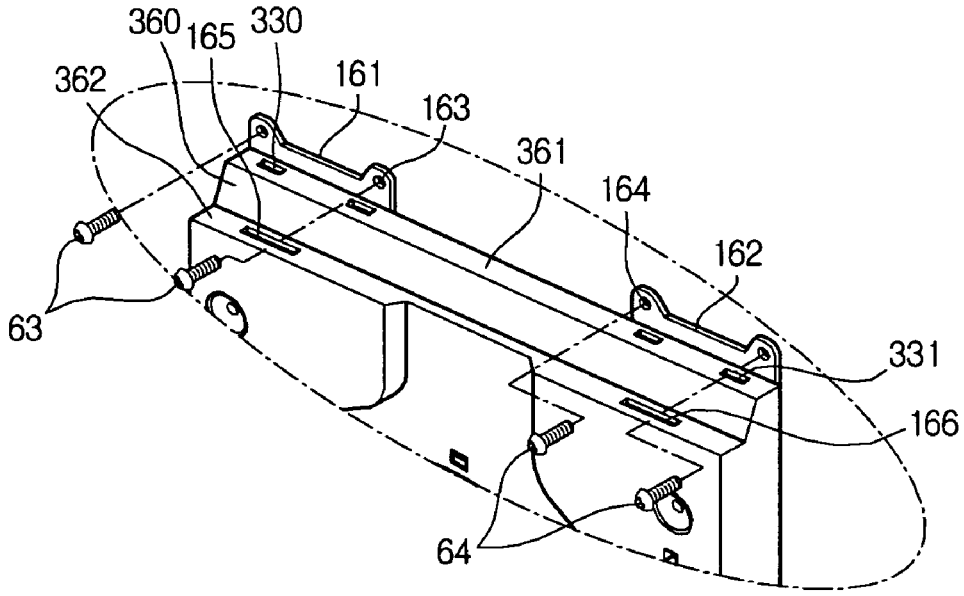
FIG. 15 is an enlarged perspective view of portion F of FIG. 14.
Figure 16:
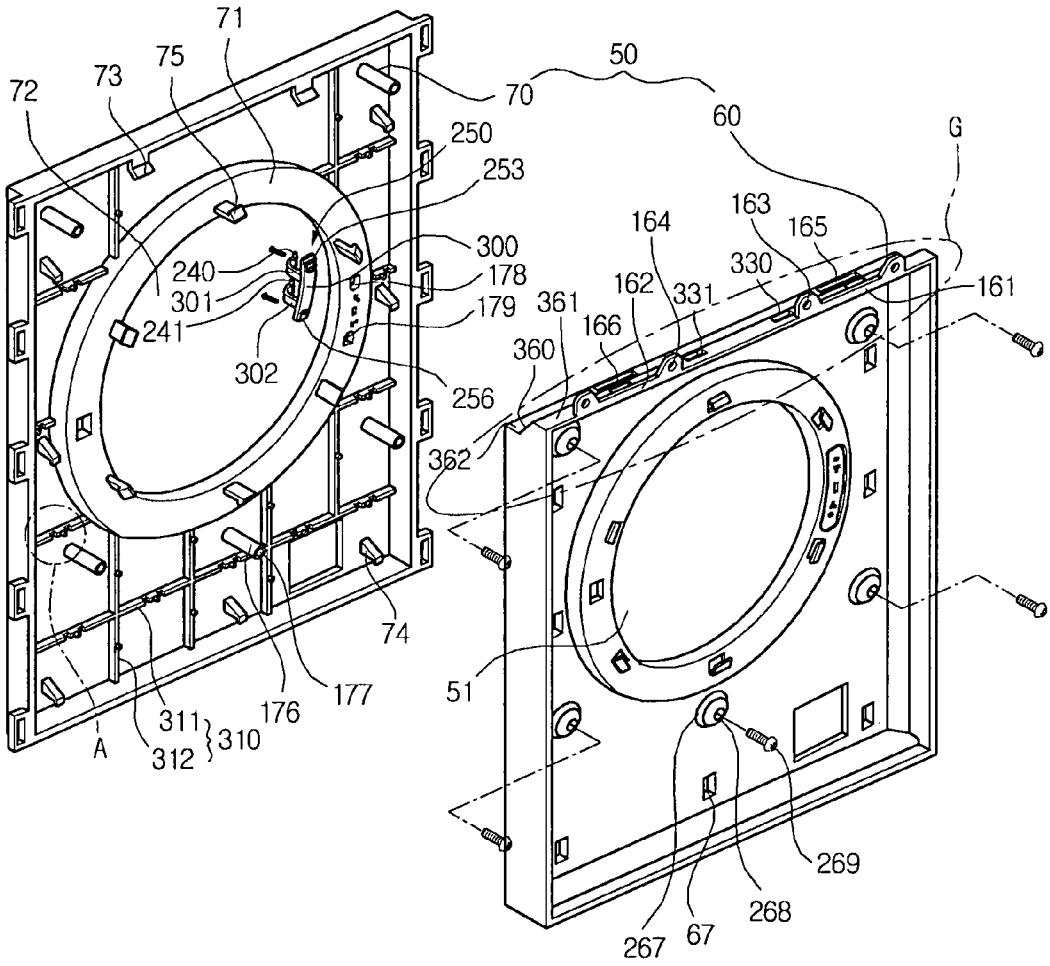
FIG. 16 is a rear perspective view showing a disassembled state of a front cabinet cover and a rear cabinet cover of the washing machine depicted in FIG. 14.
Figure 17:
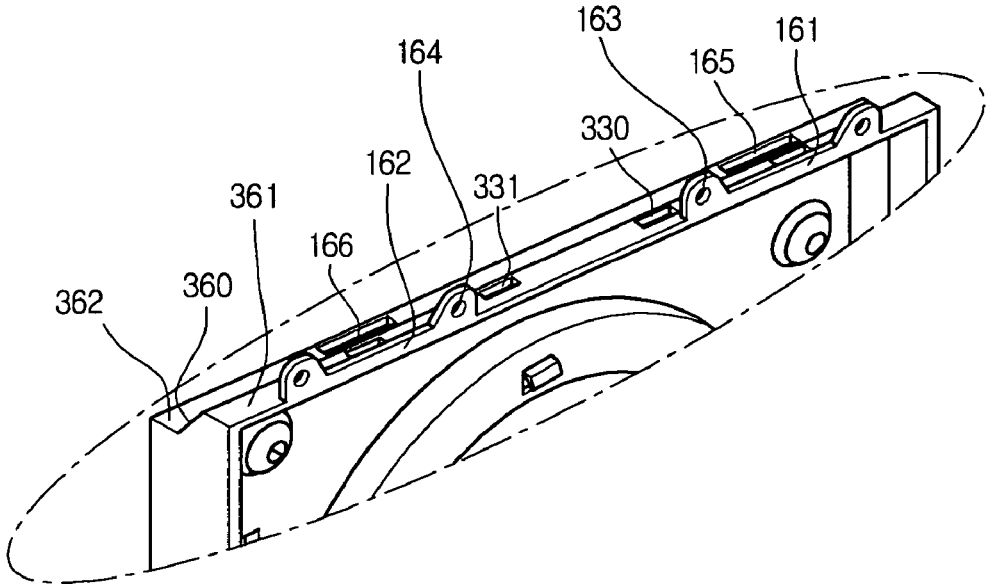
FIG. 17 is an enlarged perspective view of portion G of FIG. 16.
Figure 18:
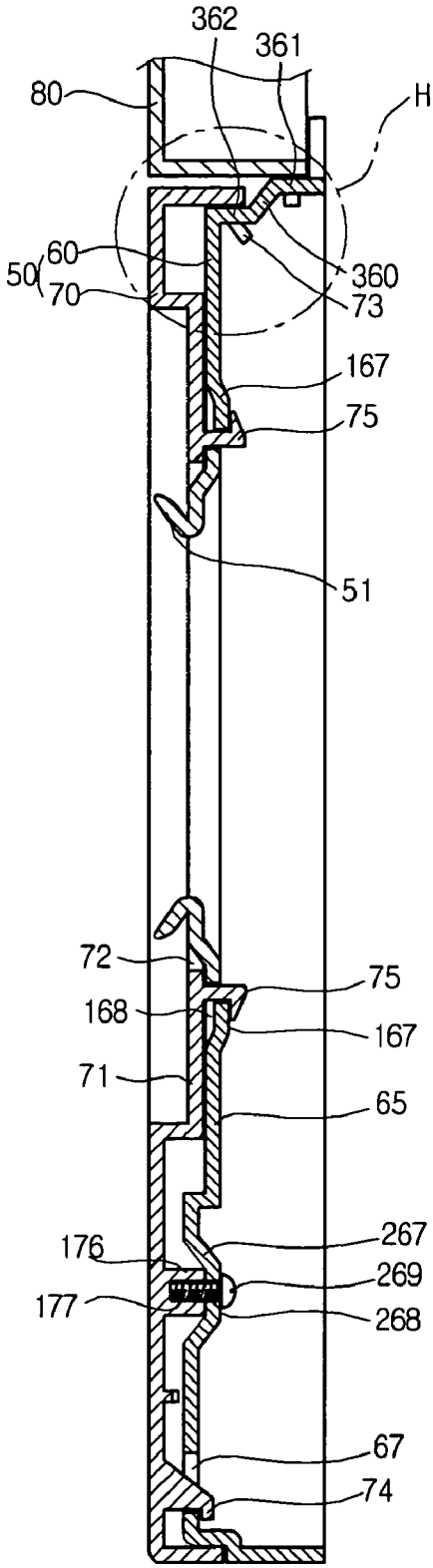
FIG. 18 is a sectional view showing an assembled state of the front cabinet cover and the rear cabinet cover of the washing machine depicted in FIG. 14.
Figure 19:
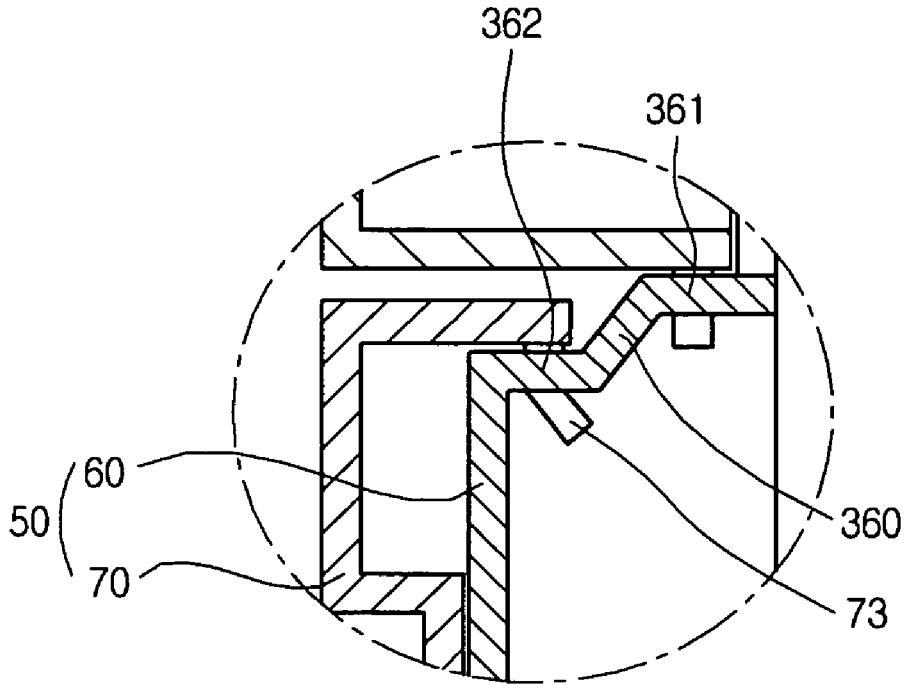
FIG. 19 is an enlarged view of portion H of FIG. 18.

FIG. 14 is an exploded perspective view of a washing machine according to a fourth embodiment of the present invention; FIG. 15 is an enlarged perspective view of portion F of FIG. 14; FIG. 16 is a rear perspective view showing a disassembled state of a front cabinet cover and a rear cabinet cover of the washing machine depicted in FIG. 14; FIG. 17 is an enlarged perspective view of portion G of FIG. 16; FIG. 18 is a sectional view showing an assembled state of the front cabinet cover and the rear cabinet cover of the washing machine depicted in FIG. 14; and FIG. 19 is an enlarged view of portion H of FIG. 18.

Referring to FIGS. 14 to 19, a rear cabinet cover 60 includes a drain passage forming portion such as a sloped portion 360 directing water form a top surface of the rear cabinet cover 60 down to a front surface of the rear cabinet cover 60 and a rear surface of a front cabinet cover 70.

The rear cabinet cover 60 further includes a lower horizontal portion 362 horizontally extending from a front end of the sloped portion 360. When assembled, an upper end of the front cabinet cover 70 is placed on the lower horizontal portion 362 of the rear cabinet cover 60.

The rear cabinet cover 60 further includes hooking holes 165 and 166 in the lower horizontal portion 362.

The rear cabinet cover 60 further includes an upper horizontal portion 361 horizontally extending form a rear end of the sloped portion 360. When assembled, a control panel 80 is placed on the upper horizontal portion 361.

The control panel 80 includes a plurality of coupling protrusions on a bottom surface, and corresponding coupling holes 330 and 331 are formed in the upper horizontal portion 361. Therefore, the control panel 80 can be installed on the rear cabinet cover 60 by inserting the coupling protrusions into the coupling holes 330 and 331.

Water draining from a front portion of the washing machine will now be described according to the fourth embodiment of the present invention.

If water permeates between the control panel 80 and the front cabinet cover 70, the water flows backward along the top surface of the front cabinet cover 70, and then flows down along the sloped portion 360 of the rear cabinet cover 60.

The water flows down along the sloped portion 360 in a front direction between the lower horizontal portion 362 and the upper end of the front cabinet cover 70. Then, the water flows down between a rear surface of the front cabinet cover 70 and a front surface of the rear cabinet cover 60.

The water flown down between the front cabinet cover 70 and the rear cabinet cover 60 is directed downward through drain passages 322 and 323 (refer to FIG. 4), and then is discharged to a lower side of a cabinet cover 50 through lower ends of the front cabinet cover 70 and the rear cabinet cover 60.

Figure 20:
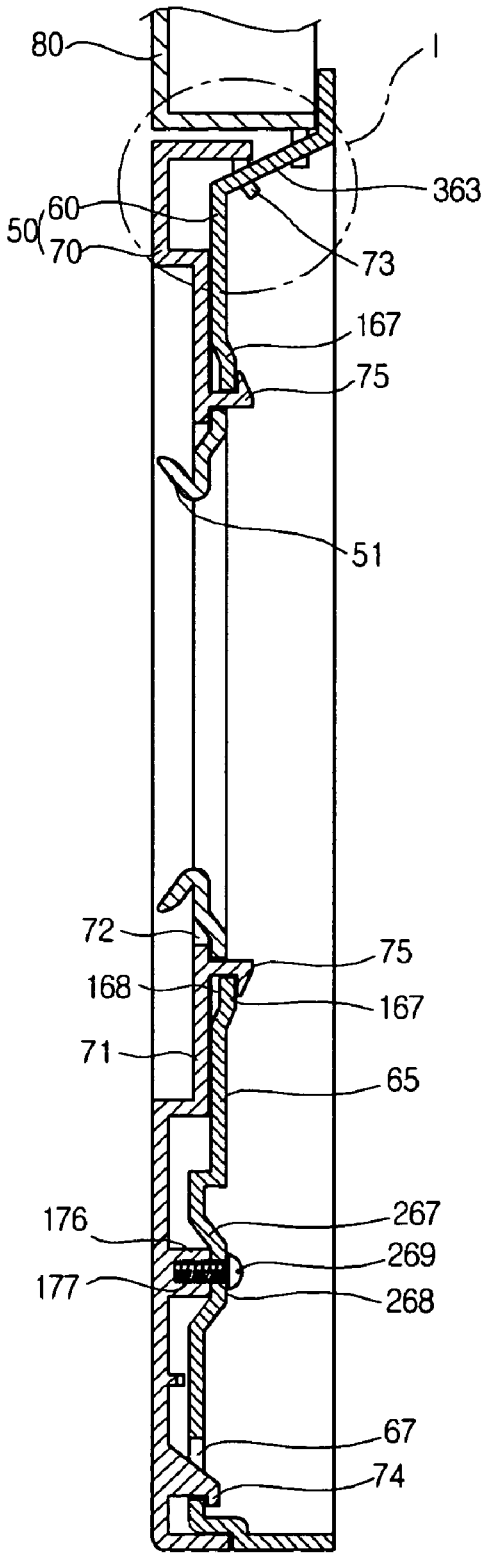
FIG. 20 is a sectional view showing an assembled state of a front cabinet cover and a rear cabinet cover of a washing machine according to a fifth embodiment of the present invention.
Figure 21:
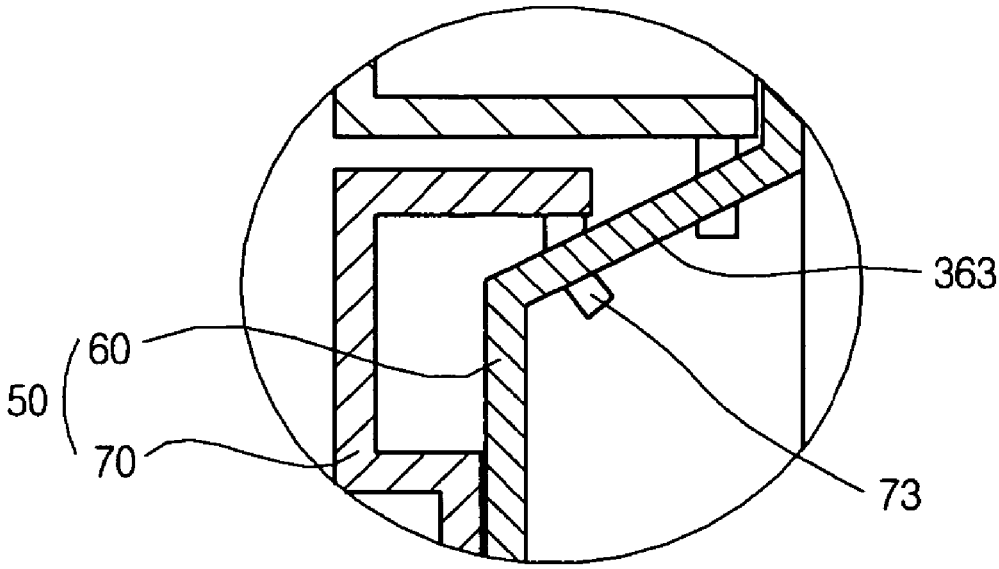
FIG. 21 is an enlarged view of portion I of FIG. 20.

FIG. 20 is a sectional view showing an assembled state of a front cabinet cover and a rear cabinet cover of a washing machine according to a fifth embodiment of the present invention, and FIG. 21 is an enlarged view of portion I of FIG. 20.

Referring to FIG. 20 and 21, a rear cabinet cover 60 includes a top portion entirely sloped down in a forward direction. The sloped top portion is denoted by reference numeral 363.

The entire top surface of the rear cabinet cover 60 is sloped down such that water flowing onto the top surface of the rear cabinet cover 60 can be directed in a desired direction along the sloped top portion 363 and then drained to the outside. Therefore, water can more effectively drain.

According to the washing machine of the present invention, the front cabinet cover covering the front surface of the rear cabinet cover includes the ribs on its rear surface, and drain passages are defined in the ribs, such that water permeated between the front cabinet cover and the rear cabinet cover can drain downwardly. Therefore, noise and corrosion by the water between the front cabinet cover and the rear cabinet cover can be prevented.

Further, according to the washing machine of the present invention, since the ribs are formed on the rear surface of the front cabinet cover in horizontal and vertical directions, water draining structure can be easily and simply obtained by forming the drain passages only in the horizontal ribs.

Further, according to the washing machine of the present invention, the front cabinet cover includes the protrusions on the ribs in close proximity to the drain passages formed in the ribs such that the drain passages can be maintained at a predetermined distance from the front surface of the rear cabinet cover. Therefore, water can drain more effectively and certainly.

Further, according to the washing machine of the present invention, the rear cabinet cover includes the drain hole in the top center portion and the guide portion formed on at least one side of the drain hole for guiding water to the drain hole. Therefore, water can drain effectively from the top surface of the rear cabinet cover through the drain hole, thus preventing corrosion of the top surface of the rear cabinet cover.

Further, according to the washing machine of the present invention, since wafer flowing onto the top surface of the rear cabinet cover drains down to the rear center portion of the rear cabinet cover, the hinge member and the door switch which are formed on both lateral sides of the fabric opening can be protected from the draining water. Therefore, corrosion of the hinge member and short-circuit/fire of the door switch can be prevented.

Further, according to the washing machine of the present invention, the guide portions provided on the top surface of the rear cabinet cover have a convex or concave shape that can be easily formed.

Further, according to the washing machine of the present invention, the rear cabinet cover can include the sloped portion on its top surface to allow water to flow down between the front surface of the rear cabinet cover and the rear surface of the front cabinet cover from the top surface of the rear cabinet cover. Thus, corrosion of the top surface of the rear cabinet cover can be prevented.

Further, according to the washing machine of the present invention, the rear cabinet cover can further include the lower horizontal portion extending from the front end of the sloped portion, such that the front cabinet cover can be easily coupled to the rear cabinet cover by placing the upper end of the front cabinet cover on the lower horizontal portion of the rear cabinet cover.

Further, according to the washing machine of the present invention, the rear cabinet cover can further include the upper horizontal portion extending from the rear end of the sloped portion, such that the control panel can be easily coupled to the rear cabinet cover by placing the control panel on the upper horizontal portion.

In addition, according to the washing machine of the present invention, the entire top surface of the rear cabinet cover can be sloped down in a front direction. In this case, the rear cabinet cover can be manufactured by a simple process.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing machine comprising:

a cabinet provided with a tub;

at least one front frame provided at a front side of the cabinet;

a rear cabinet cover coupled to a front side of the front frame, the rear cabinet cover formed with one opening for inserting fabrics;

a front cabinet cover coupled with a front side of the rear cabinet cover, the front cabinet cover formed with another opening and having a size corresponding to the rear cabinet cover;

a door configured to open and close the openings;

at least one rib configured to protrude from one of the front cabinet cover and the rear cabinet cover, the at least one rib protruding in a direction of the other cabinet cover;

a recessed portion configured to be recessed from the rib in a direction of the one cabinet cover of the front cabinet cover and the rear cabinet cover;

a protrusion configured to protrude from the rib in a direction of the other cabinet cover; and a drain passage formed between the rear cabinet cover and the front cabinet cover, the drain passage having a size corresponding to a depth of the recessed portion and width of the protrusion.

2. The washing machine according to claim 1, further comprises:

a drain hole formed in an upper portion of the rear cabinet cover; and a guide portion guiding water to the drain hole.

3. The washing machine according to claim 1, further comprises a sloped portion formed on an upper portion of the rear cabinet cover for allowing downflow of water.

4. The washing machine according to claim 1, wherein the drain passage is formed in a vertical direction of the washing machine.

5. The washing machine according to claim 1, wherein the drain passage is formed on each side of the protrusion.

6. A washing machine comprising:

a cabinet provided with a tub;

at least one front frame provided at a front side of the cabinet;

a plurality of cabinet covers attached to a front side of the front frame, wherein each of the cabinet covers include opening portions having a size corresponding to each other for inserting fabrics, respectively;

a door configured to open and close the opening portion;

a drain hole formed in an upper portion of the cabinet covers, the drain hole configured to drop water downwardly between the cabinet cover;

a guide portion guiding water to the drain hole; and a rib configured to protrude from one of the cabinet covers to another one of the cabinet covers, the rib having a protrusion configured to further protrude toward the another one of the cabinet covers;

a drain passage including a recessed portion configured to be recessed from the rib, wherein the drain passage has a width that is a sum of the protrusion and the recessed portion.

7. The washing machine according to claim 6, further comprising a door and a hinge member for coupling the door to the cabinet covers, wherein the drain hole and the guide portion protect the hinge member from the water.

8. The washing machine according to claim 6, wherein the drain hole is formed in a center portion of a top end of the cabinet covers.

9. The washing machine according to claim 6, wherein at least one of the guide portion and the upper portion of the cabinet covers is sloped down toward the drain hole for guiding water to the drain hole.

10. The washing machine according to claim 6, wherein the guide portion is formed on each side of the drain hole.

11. The washing machine according to claim 6, wherein the guide portion is formed on the upper portion of the cabinet covers into a recessed shape.

12. The washing machine according to claim 11, wherein the guide portion has a closed end opposite to the drain hole.

13. The washing machine according to claim 6, wherein the guide portion is formed on the upper portion of the cabinet covers into a protruded shape.

14. The washing machine according to claim 6, wherein the guide portion is formed along a horizontal direction of the cabinet covers and has an elongated shape.

15. A washing machine comprising:

a cabinet provided with a tub;

at least one front frame provided at a front side of the cabinet;

a rear cabinet cover coupled to a front side of the front frame, the rear cabinet cover formed with one opening for inserting fabrics;

a front cabinet cover coupled with a front side of the rear cabinet cover, the front cabinet cover formed with another opening and having a size corresponding to the rear cabinet cover;

a door configured to open and close the openings;

a sloped portion formed on at least one upper portion of the front cabinet cover and the rear cabinet cover, the sloped portion guiding water to drain downwardly between the front cabinet cover and the rear cabinet cover;

a rib configured to protrude from the front cabinet cover toward the rear cabinet cover;

a recessed portion configured to be recessed from the rib in a direction of the front cabinet cover; and a protrusion configured to protrude from the rib in a direction of the rear cabinet cover, a drain passage formed between the rear cabinet cover and the front cabinet cover, the drain passage having a size corresponding to a depth of the recessed portion and width of the protrusion.

16. The washing machine according to claim 15, wherein the sloped portion becomes lower toward a front end of the front cabinet cover or the rear cabinet cover.

17. The washing machine according to claim 15, further comprising a horizontal portion between the sloped portion and an edge of the front cabinet cover or the rear cabinet cover.

18. The washing machine according to claim 17, wherein the horizontal portion comprises:

an upper horizontal portion formed on an upper side of the sloped portion; and a lower horizontal portion formed on a lower side of the sloped portion.

19. The washing machine according to claim 15, wherein the sloped portion is formed entirely on the upper portion of the front cabinet cover or the rear cabinet cover.

20. The washing machine according to claim 1, wherein the at least one rib comprises a plurality of ribs, and wherein the plurality of ribs include horizontal ribs formed on the rear surface of the front cabinet cover in a horizontal direction and vertical ribs formed on the rear surface of the front cabinet cover in a vertical direction.

* * * * *